US011382405B2

(12) United States Patent
Wagner et al.

(10) Patent No.: US 11,382,405 B2
(45) **Date of Patent: *Jul. 12, 2022**

(54) LANYARD

(71) Applicant: Milwaukee Electric Tool Corporation, Brookfield, WI (US)

(72) Inventors: Andrew G. Wagner, Lisbon, WI (US); Trent T. Bauters, West Allis, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/931,118

(22) Filed: Jul. 16, 2020

(65) Prior Publication Data

US 2020/0345125 A1 Nov. 5, 2020

Related U.S. Application Data

(63) Continuation of application No. 16/240,546, filed on Jan. 4, 2019, now Pat. No. 10,716,390, which is a continuation of application No. PCT/US2018/066873, filed on Dec. 20, 2018.

(60) Provisional application No. 62/609,078, filed on Dec. 21, 2017.

(51) Int. Cl.
*A45F 5/00* (2006.01)

(52) U.S. Cl.
CPC ..... *A45F 5/00* (2013.01); *A45F 2005/006* (2013.01); *A45F 2200/0575* (2013.01)

(58) Field of Classification Search
CPC ..... A45F 5/00; A45F 2005/006; A45F 2200/0575
USPC ..... 224/269
See application file for complete search history.

(56) References Cited

U.S. PATENT DOCUMENTS

| | | | |
|---|---|---|---|
| 4,765,037 | A | 8/1988 | Perry |
| 5,229,178 | A | 7/1993 | Zemitis |
| 5,871,193 | A | 2/1999 | Jacobs et al. |
| 5,970,697 | A | 10/1999 | Jacobs et al. |
| 6,216,319 | B1 | 4/2001 | Elkins |

(Continued)

FOREIGN PATENT DOCUMENTS

| | | |
|---|---|---|
| CN | 101711912 | 5/2010 |
| KR | 20-0208710 | 1/2001 |
| WO | WO14088603 | 6/2014 |

OTHER PUBLICATIONS

International Search Report and Written Opinion for International Application No. PCT/US2018/066873, dated Apr. 18, 2019, 12 pages.

(Continued)

*Primary Examiner* — Peter N Helvey
(74) *Attorney, Agent, or Firm* — Reinhart Boerner Van Deuren s.c.

(57) ABSTRACT

A lanyard with attachment members such as a tool holding member, tether key, or carabiner, is provided. The lanyard includes one or more elastic cords within a sheath. The sheath has a much lower elasticity than the elastic cord. The higher spring constant or modulus of elasticity of the sheath limits the total extended length of the lanyard in operation. The elastic cords stretch to absorb the energy of falling equipment up to the length of the outer sheath. The attachment members may be attached to the sheath or may include components of the sheath and or the elastic cord. The lanyard allows for an elastic response to absorb the energy of a falling tool and a restraint to the total extended length of the lanyard.

20 Claims, 15 Drawing Sheets

(56) References Cited

U.S. PATENT DOCUMENTS

| | | | |
|---|---|---|---|
| 6,264,081 | B1 | 7/2001 | Wojciak et al. |
| 6,299,040 | B1 | 10/2001 | Matias |
| 6,487,756 | B1 | 12/2002 | Vidal, Jr. |
| 6,732,834 | B2 | 5/2004 | Colorado |
| 6,776,317 | B1 | 8/2004 | Parker |
| 6,880,702 | B1 | 4/2005 | Colorado |
| 6,959,784 | B2 | 11/2005 | Diggle et al. |
| 7,124,470 | B2 | 10/2006 | Alanis |
| 7,784,258 | B2 | 8/2010 | Hess |
| 7,963,365 | B2 | 6/2011 | Grilliot et al. |
| 8,061,479 | B2 | 11/2011 | Harris et al. |
| 8,061,480 | B2 | 11/2011 | Grilliot et al. |
| 8,117,678 | B2 | 2/2012 | Moreau et al. |
| 8,312,964 | B2 | 11/2012 | Harris et al. |
| D675,084 | S | 1/2013 | Moreau et al. |
| D692,231 | S | 10/2013 | Moreau et al. |
| 8,757,455 | B2 | 6/2014 | Smalley |
| 8,863,898 | B2 | 10/2014 | Harris, Jr. |
| 8,931,593 | B2 | 1/2015 | Harris et al. |
| 9,028,401 | B1 | 5/2015 | Bacich et al. |
| 9,033,199 | B2 | 5/2015 | Weber |
| 9,101,391 | B2 | 8/2015 | Bacich et al. |
| 9,199,105 | B1 | 12/2015 | Hung |
| 9,232,850 | B2 | 1/2016 | Moreau et al. |
| 9,242,127 | B1 | 1/2016 | London, Sr. et al. |
| 9,339,100 | B2 | 5/2016 | Moreau et al. |
| 9,402,457 | B2 | 8/2016 | Moreau et al. |
| 9,468,285 | B2 | 10/2016 | Martinez |
| 9,480,327 | B2 | 11/2016 | Moreau et al. |
| 9,486,655 | B1 | 11/2016 | London, Sr. et al. |
| 9,510,634 | B2 | 12/2016 | Bookbinder et al. |
| 9,885,379 | B1 | 2/2018 | Hung |
| 2002/0074185 | A1 | 6/2002 | Colorado |
| 2002/0174521 | A1 | 11/2002 | Vidal, Jr. |
| 2004/0231101 | A1 | 11/2004 | Alanis |
| 2005/0039980 | A1 | 2/2005 | Diggle et al. |
| 2005/0173188 | A1 | 8/2005 | Lewis et al. |
| 2005/0177928 | A1 | 8/2005 | Moreau et al. |
| 2005/0211188 | A1 | 9/2005 | Grilliot et al. |
| 2005/0283952 | A1 | 12/2005 | Talbot et al. |
| 2005/0284696 | A1 | 12/2005 | Grilliot et al. |
| 2006/0070800 | A1 | 4/2006 | Lewis et al. |
| 2006/0113147 | A1 | 6/2006 | Harris, Jr. |
| 2006/0272890 | A1 | 12/2006 | Harmon et al. |
| 2007/0012513 | A1 | 1/2007 | Grilliot et al. |
| 2007/0048554 | A1 | 3/2007 | Jacobs et al. |
| 2007/0102240 | A1 | 5/2007 | Wilson |
| 2007/0137163 | A1 | 6/2007 | Hess |
| 2007/0202286 | A1 | 8/2007 | Jacobs et al. |
| 2008/0009185 | A1 | 1/2008 | Knoll et al. |
| 2008/0047997 | A1 | 2/2008 | Mayfield |
| 2008/0134416 | A1 | 6/2008 | Moreau et al. |
| 2008/0163464 | A1 | 7/2008 | Baumann |
| 2009/0009185 | A1 | 1/2009 | Herbst |
| 2009/0056088 | A1 | 3/2009 | Petzl et al. |
| 2010/0122874 | A1 | 5/2010 | Harris, Jr. |
| 2010/0147912 | A1 | 6/2010 | Salentine |
| 2011/0042533 | A1 | 2/2011 | Austin |
| 2012/0048646 | A1 | 3/2012 | Harris, Jr. |
| 2012/0073904 | A1 | 3/2012 | Harris, Jr. |
| 2012/0170873 | A1 | 7/2012 | Mathews |
| 2012/0267403 | A1 | 10/2012 | Ward, Jr. |
| 2012/0312852 | A1 | 12/2012 | Smalley |
| 2013/0068561 | A1 | 3/2013 | Harris, Jr. |
| 2013/0256349 | A1 | 10/2013 | Styth et al. |
| 2013/0299544 | A1 | 11/2013 | Moreau et al. |
| 2014/0013544 | A1 | 1/2014 | Moreau et al. |
| 2014/0076945 | A1 | 3/2014 | Weber |
| 2014/0201888 | A1 | 7/2014 | Bookbinder et al. |
| 2014/0259551 | A1 | 9/2014 | Egbert |
| 2014/0339017 | A1 | 11/2014 | Wood |
| 2015/0033506 | A1 | 2/2015 | Leslie |
| 2015/0133727 | A1 | 5/2015 | Bacich et al. |
| 2015/0133737 | A1 | 5/2015 | Bacich et al. |
| 2015/0133779 | A1 | 5/2015 | Yurek et al. |
| 2015/0142045 | A1 | 5/2015 | Bachich |
| 2015/0217150 | A1 | 8/2015 | Harris |
| 2015/0289633 | A1 | 10/2015 | Moreau et al. |
| 2015/0351524 | A1 | 12/2015 | Martinez |
| 2016/0081446 | A1 | 3/2016 | Maddox et al. |
| 2016/0095420 | A1 | 4/2016 | Moreau et al. |
| 2016/0095421 | A1 | 4/2016 | Moreau et al. |
| 2016/0107005 | A1 | 4/2016 | Rogelja |
| 2016/0143384 | A1 | 5/2016 | Moreau et al. |
| 2016/0144530 | A1 | 5/2016 | Weinig et al. |
| 2016/0183620 | A1 | 6/2016 | Moreau et al. |
| 2016/0208835 | A1 | 7/2016 | Derr |
| 2016/0286943 | A1 | 10/2016 | Andersen et al. |
| 2017/0281989 | A1 | 10/2017 | Wood |
| 2018/0038408 | A1 | 2/2018 | Hung |

OTHER PUBLICATIONS

International Preliminary Report on Patentability for International Application No. PCT/2017/047887, dated Mar. 7, 2019, 16 pages.

| WEIGHT-RATE OF LAYNARD | DROP TEST HEIGHT | WEIGHT SUPPORTED BY LANYARD | PEAK FORCE | PRE-DROP LENGTH 110 OF LOOP PORTION 40 | STRETCHED LENGTH 110 OF LOOP PORTION 40 | PERCENTAGE INCREASE LENGTH 110 OF LOOP PORTION 40 | UN-TENSIONED LENGTH 118 OF ELASTIC CORD 34 | FULLY STRETCHED LENGTH 118 OF ELASTIC CORD 34 | PERCENTAGE INCREASE OF LENGTH 118 OF ELASTIC CORD 34 | PRE-DROP LENGTH 130 OF LOOP 30 | STRETCHED LENGTH 130 OF LOOP 30 | PERCENTAGE INCREASE OF LENGTH 130 OF LOOP 30 | PRE-DROP TOTAL LENGTH 102 | STRETCHED TOTAL LENGTH 102 | PERCENTAGE INCREASE OF TOTAL LENGTH 102 |
|---|---|---|---|---|---|---|---|---|---|---|---|---|---|---|---|
| 10 lb | 2X | 10 lb | 82 lbf 1ST DROP | 32 mm | 38 mm | 19% | 521 mm | 938 mm | 80% | 210 mm | 294 mm | 40% | 921 mm | 1428 mm | 55% |
| | 2X | 10 lb | 123 lbf PEAK AFTER 10 DROPS | 32 mm | 38 mm | 19% | 521 mm | 990 mm | 90% | 210 mm | 305 mm | 45% | 921 mm | 1491 mm | 62% |
| | 2X | 20 lb | 266 lbf PEAK AFTER 3 DROPS | 32 mm | 40 mm | 25% | 521 mm | 1110 mm | 113% | 210 mm | 329 mm | 57% | 921 mm | 1637 mm | 78% |
| 10 lb | 2X | 10 lb | 92 lbf 1ST DROP | 32 mm | 38 mm | 19% | 981 mm | 1795 mm | 83% | 210 mm | 297 mm | 41% | 1381 mm | 2288 mm | 66% |
| | 2X | 10 lb | 137 lbf PEAK AFTER 10 DROPS | 32 mm | 39 mm | 22% | 981 mm | 1893 mm | 93% | 210 mm | 308 mm | 47% | 1381 mm | 2348 mm | 70% |
| | 2X | 20 lb | 288 lbf PEAK AFTER 3 DROPS | 32 mm | 41 mm | 28% | 981 mm | 2109 mm | 115% | 210 mm | 331 mm | 58% | 1381 mm | 2639 mm | 91% |
| 15 lb | 2X | 15 lb | 122 lbf 1ST DROP | 32 mm | 38 mm | 19% | 521 mm | 753 mm | 45% | 210 mm | 304 mm | 45% | 921 mm | 1248 mm | 36% |
| | 2X | 15 lb | 209 lbf PEAK AFTER 10 DROPS | 32 mm | 40 mm | 25% | 521 mm | 795 mm | 53% | 210 mm | 320 mm | 52% | 921 mm | 1308 mm | 43% |
| | 2X | 30 lb | 406 lbf PEAK AFTER 3 DROPS | 32 mm | 42 mm | 31% | 521 mm | 854 mm | 64% | 210 mm | 344 mm | 64% | 921 mm | 1393 mm | 52% |
| 50 lb | 2X | 50 lb | 752 lbf 1ST DROP | 35 mm | 35 mm | 0% | 552 mm | 762 mm | 38% | 222 mm | 224 mm | 1% | 1015 mm | 1227 mm | 21% |
| | 2X | 50 lb | 960 lbf PEAK AFTER 10 DROPS | 35 mm | 36 mm | 3% | 552 mm | 778 mm | 41% | 222 mm | 226 mm | 2% | 1015 mm | 1246 mm | 23% |
| | 2X | 100 lb | 1572 lbf PEAK AFTER 3 DROPS | 35 mm | 36 mm | 3% | 552 mm | 817 mm | 48% | 222 mm | 229 mm | 3% | 1015 mm | 1288 mm | 27% |

FIG. 12

| LENGTH | ORIGINAL DIMENSION | 2x HEIGHT, 10lb, FIRST DROP (82lbf) DIMENSION \| ELONGATION | 2x HEIGHT, 10lb, PEAK FORCE (123 lbf, AFTER 10 DROPS) DIMENSION \| ELONGATION | 2x HEIGHT, 20lb, PEAK FORCE (268 lbf, AFTER 3 DROPS) DIMENSION \| ELONGATION |
|---|---|---|---|---|
| 106 | 86 mm | 86 mm \| 0% | 86 mm \| 0% | 86 mm \| 0% |
| 110 | 32 mm | 38 mm \| 19% | 38 mm \| 19% | 40 mm \| 25% |
| 114 | 36 mm | 36 mm \| 0% | 36 mm \| 0% | 36 mm \| 0% |
| 118 | 521mm | 938 mm \| 80% | 990 mm \| 90% | 1110 mm \| 113% |
| 122 | 36 mm | 36 mm \| 0% | 36 mm \| 0% | 36 mm \| 0% |
| 130 | 210 mm | 294 mm \| 40% | 305 mm \| 45% | 329 mm \| 57% |
| 102 | 921mm | 1428 mm \| 55% | 1491 mm \| 62% | 1637 mm \| 78% |

FIG. 13

| COMPONENT | ORIGINAL DIMENSION | 2x HEIGHT, 10lb, FIRST DROP (92lbf) DIMENSION \| ELONGATION | 2x HEIGHT, 10lb, PEAK FORCE (137 lbf, AFTER 10 DROPS) DIMENSION \| ELONGATION | 2x HEIGHT, 20lb, PEAK FORCE (288 lbf, AFTER 3 DROPS) DIMENSION \| ELONGATION |
|---|---|---|---|---|
| 106 | 86 mm | 86 mm \| 0% | 86 mm \| 0% | 86 mm \| 0% |
| 110 | 32 mm | 38 mm \| 19% | 39 mm \| 22% | 41 mm \| 28% |
| 114 | 36 mm | 36 mm \| 0% | 36 mm \| 0% | 36 mm \| 0% |
| 118 | 981mm | 1795 mm \| 83% | 1893 mm \| 93% | 2109 mm \| 115% |
| 122 | 36 mm | 36 mm \| 0% | 36 mm \| 0% | 36 mm \| 0% |
| 130 | 210 mm | 297 mm \| 41% | 308 mm \| 47% | 331 mm \| 58% |
| 102 | 1381mm | 2288 mm \| 66% | 2348 mm \| 70% | 2639 mm \| 91% |

FIG. 14

| COMPONENT | ORIGINAL DIMENSION | 2x HEIGHT, 10lb, FIRST DROP (92lbf) DIMENSION \| ELONGATION | 2x HEIGHT, 10lb, PEAK FORCE (137 lbf, AFTER 10 DROPS) DIMENSION \| ELONGATION | 2x HEIGHT, 20lb, PEAK FORCE (288 lbf, AFTER 3 DROPS) DIMENSION \| ELONGATION |
|---|---|---|---|---|
| 106 | 86 mm | 86 mm \| 0% | 86 mm \| 0% | 86 mm \| 0% |
| 110 | 32 mm | 38 mm \| 19% | 40 mm \| 25% | 42 mm \| 31% |
| 114 | 36 mm | 36 mm \| 0% | 36 mm \| 0% | 36 mm \| 0% |
| 118 | 521mm | 753 mm \| 45% | 795 mm \| 53% | 854 mm \| 64% |
| 122 | 36 mm | 36 mm \| 0% | 36 mm \| 0% | 36 mm \| 0% |
| 130 | 210 mm | 304 mm \| 45% | 320 mm \| 52% | 344 mm \| 64% |
| 102 | 921mm | 1253 mm \| 36% | 1313 mm \| 43% | 1398 mm \| 52% |

FIG. 15

| COMPONENT | ORIGINAL DIMENSION | 2x HEIGHT, 10lb, FIRST DROP (92lbf) DIMENSION \| ELONGATION | 2x HEIGHT, 10lb, PEAK FORCE (137 lbf, AFTER 10 DROPS) DIMENSION \| ELONGATION | 2x HEIGHT, 20lb, PEAK FORCE (288 lbf, AFTER 3 DROPS) DIMENSION \| ELONGATION |
|---|---|---|---|---|
| 106 | 154 mm | 154 mm \| 0% | 154 mm \| 0% | 154 mm \| 0% |
| 110 | 35 mm | 35 mm \| 19% | 36 mm \| 3% | 36 mm \| 3% |
| 114 | 21 mm | 21 mm \| 0% | 21 mm \| 0% | 21 mm \| 0% |
| 118 | 552 mm | 762 mm \| 38% | 778 mm \| 41% | 817 mm \| 48% |
| 122 | 31 mm | 31 mm \| 0% | 31 mm \| 0% | 31 mm \| 0% |
| 130 | 222 mm | 224 mm \| 1% | 226 mm \| 2% | 229 mm \| 3% |
| 102 | 1015 mm | 1227 mm \| 21% | 1246 mm \| 23% | 1288 mm \| 27% |

FIG. 16

| WEIGHT-RATE OF LAYBARD | DROP TEST HEIGHT | WEIGHT SUPPORTED BY LAYBARD | PEAK FORCE | PRE-DROP LENGTH 248 OF LOOP AT LOOP PORTION 202 | STRETCHED LENGTH 248 OF LOOP PORTION 202 | PERCENTAGE INCREASE OF LENGTH 248 OF LOOP PORTION 202 | UN-TENSIONED LENGTH 256 OF ELASTIC CORD 34 | FULLY STRETCHED LENGTH 256 OF ELASTIC CORD 34 | PERCENTAGE INCREASE OF LENGTH 256 OF ELASTIC CORD 34 | PRE-DROP LENGTH 264 OF LOOP PORTION 222 | STRETCHED LENGTH 264 OF LOOP PORTION 222 | PERCENTAGE INCREASE OF LENGTH 264 OF LOOP PORTION 222 | PRE-DROP LENGTH 272 TETHER 230 | STRETCHED LENGTH 272 OF TETHER 230 | PERCENTAGE INCREASE OF LENGTH 272 TETHER 230 | PRE-DROP LENGTH 276 OF LOOP 236 | STRETCHED LENGTH 276 OF LOOP 236 | PERCENTAGE INCREASE OF LENGTH 276 OF LOOP 236 | PRE-DROP TOTAL LENGTH 240 | STRETCHED TOTAL LENGTH 240 | PERCENTAGE INCREASE OF TOTAL LENGTH 240 |
|---|---|---|---|---|---|---|---|---|---|---|---|---|---|---|---|---|---|---|---|---|---|
| | 2X | 10lb | 93lbf FIRST DROP | 32 mm | 38 mm | 19% | 465 mm | 846 mm | 82% | 34 mm | 40 mm | 19% | 96 mm | 116 mm | 21% | 170 mm | 231 mm | 36% | 1046 mm | 1505 mm | 46% |
| | 2X | 10lb 10lb | 164lbf PEAK AFTER 10 DROPS | 32 mm | 39 mm | 22% | 465 mm | 921 mm | 98% | 34 mm | 31 mm | 22% | 119 mm | 96 mm | 24% | 170 mm | 253 mm | 49% | 1046 mm | 1607 mm | 54% |
| | 2X | 20lb | 321lbf PEAK AFTER 3 DROPS | 32 mm | 41 mm | 28% | 465 mm | 1018 mm | 119% | 34 mm | 43 mm | 28% | 96 mm | 122 mm | 27% | 170 mm | 271 mm | 59% | 1046 mm | 1729 mm | 65% |

FIG. 18

| LENGTH | ORIGINAL DIMENSION | 2x HEIGHT, 10lb, FIRST DROP (93lbf) DIMENSION \| ELONGATION | 2x HEIGHT, 10lb, PEAK FORCE (164 lbf, AFTER 10 DROPS) DIMENSION \| ELONGATION | 2x HEIGHT, 20lb, PEAK FORCE (321 lbf, AFTER 3 DROPS) DIMENSION \| ELONGATION |
|---|---|---|---|---|
| 244 | 86 mm | 86 mm \| 0% | 86 mm \| 0% | 86 mm \| 0% |
| 248 | 32 mm | 38 mm \| 19% | 39 mm \| 22% | 41 mm \| 28% |
| 252 | 36 mm | 36 mm \| 0% | 36 mm \| 0% | 36 mm \| 0% |
| 256 | 465 mm | 846 mm \| 82% | 921 mm \| 98% | 1018 mm \| 119% |
| 260 | 36 mm | 36 mm \| 0% | 36 mm \| 0% | 36 mm \| 0% |
| 264 | 34 mm | 40 mm \| 19% | 41 mm \| 22% | 43 mm \| 28% |
| 268 | 91 mm | 91 mm \| 0% | 91 mm \| 0% | 91 mm \| 0% |
| 272 | 96 mm | 116 mm \| 21% | 119 mm \| 24% | 122 mm \| 27% |
| 276 | 170 mm | 231 mm \| 36% | 253 mm \| 49% | 271 mm \| 59% |
| 280 | 780 mm | 1158 mm \| 49% | 1235 mm \| 58% | 1336 mm \| 71% |
| 284 | 266 mm | 347 mm \| 31% | 372 mm \| 40% | 393 mm \| 48% |
| 240 | 1381 mm | 1505 mm \| 46% | 1607 mm \| 54% | 1729 mm \| 65% |

FIG. 19

LANYARD

CROSS-REFERENCE TO RELATED PATENT APPLICATIONS

This application is a continuation of U.S. patent application Ser. No. 16/240,546, filed Jan. 4, 2019, which is a continuation of International Application No. PCT/US2018/066873, filed Dec. 20, 2018, which claims the benefit and priority to U.S. Provisional Application No. 62/609,078, filed on Dec. 21, 2017, which are incorporated herein by reference in their entireties.

BACKGROUND OF THE INVENTION

The present invention relates generally to the field of tools. The present invention relates specifically to a lanyard for connecting tools, or batteries, to an anchor point, for example, while working at height. Lanyards are used to attach to/support tools, batteries, components, and/or other equipment to provide security when an operator inadvertently drops the equipment. Lanyards also protect the tool or equipment from damage due to a fall.

SUMMARY OF THE INVENTION

One embodiment of the invention relates to a lanyard. The lanyard includes a first attachment member, a second attachment member, a sheath, and an elastic cord. The sheath includes a first end coupled to the first attachment member and a second end coupled to the second attachment member. The sheath defines an extended length between the first and second ends. The elastic cord has a first elastic cord end and a second elastic cord end. The first elastic cord end and the second elastic cord end are both attached to the first attachment member. The elastic cord defines a loop between the first attachment member and the second attachment member wherein the elastic cord is stretchable between an un-stretched length and stretched length. The un-stretched length is less than the extended length, wherein the elasticity of the sheath is less than the elasticity of the elastic cord.

Another embodiment of the invention relates to a lanyard. The lanyard includes a first attachment member, a second attachment member, a sheath, and four or more separate elastic cords. The sheath includes a first end coupled to the first attachment member and a second end coupled to the second attachment member. The sheath defines an extended length between the first and second ends. The four or more separate elastic cords are disposed within the sheath. Each elastic cord is coupled between the first attachment member and the second attachment member on opposite ends of the sheath. The elastic cord is stretchable between an un-stretched length and a stretched length. The un-stretched length is less than the extended length, such that the elasticity of the sheath is less than the elasticity of the elastic cords.

Another embodiment of the invention relates to a lanyard. The lanyard includes a tool holding member, a carabiner, a sheath, and one or more elastic cords. The sheath includes a first end coupled to the tool holding member and a second end coupled to the carabiner. The second end of the sheath is opposite the first end. The fully extended sheath defines a limiting tensioned length of the lanyard. One or more elastic cords are disposed within the sheath and couple to the tool holding member on a first end of the sheath and the carabiner at a second end of the sheath. The one or more elastic cords have a pre-tensioned length and a tensioned length. The tensioned length of the one or more elastic cords is less than or equal to the limiting tensioned length of the sheath. The limiting tensioned length of the sheath is between a 38% and 115% increase of the pre-tensioned length of the one or more elastic cords.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which:

FIG. 12 is a Table of data showing results from various drop tests using the lanyard of FIG. 10.

FIG. 13 is a Table of data showing results from various drop tests using the lanyard of FIG. 10, as related to the Table of FIG. 11.

FIG. 14 is a Table of data showing results from various drop tests of the lanyard in FIG. 10, as related to the Table of FIG. 11.

FIG. 15 is a Table of data showing results from various drop tests of the lanyard in FIG. 10, as related to the Table of FIG. 11.

FIG. 16 is a Table of data showing results from various drop tests of the lanyard in FIG. 10, as related to the Table of FIG. 11.

FIG. 18 is a Table of data showing results from various drop tests using the lanyard of FIG. 13.

FIG. 19 is a Table of data showing results from various drop tests of the lanyard and tether shown in FIG. 13, as related to the Table of FIG. 14.

DETAILED DESCRIPTION

Figure 1:
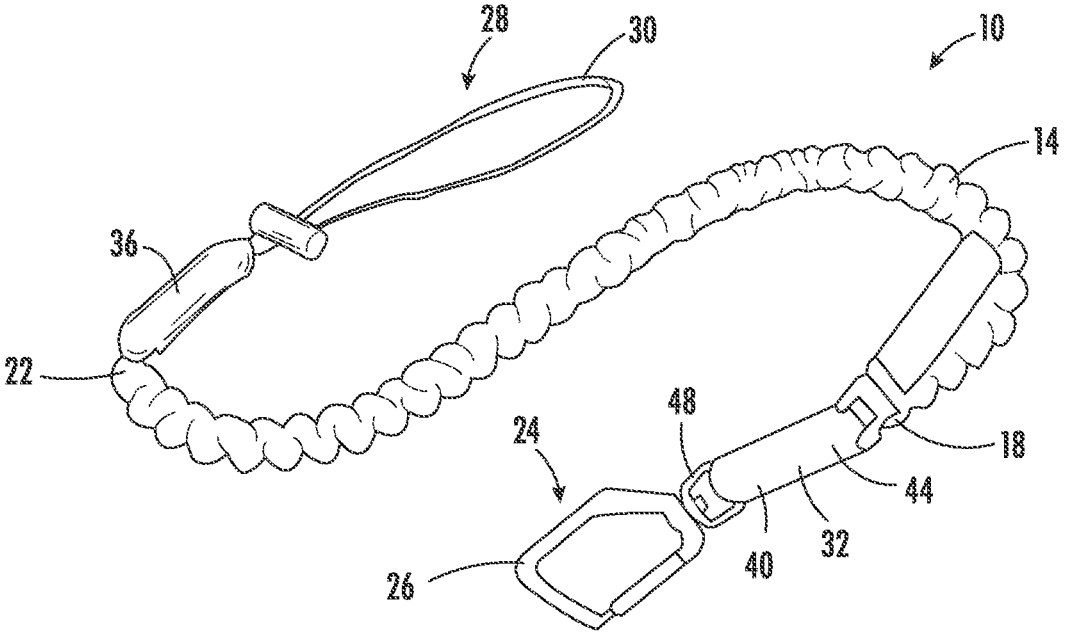
FIG. 1 is a perspective view of a lanyard with a carabiner and a loop, according to one embodiment.

Referring generally to the figures, various embodiments of a lanyard are shown. Lanyards are used as a safety measure to secure tools to an anchor point, for example, while working at height. To enhance safety, a lanyard may couple to tools and tool batteries and tether them when operating the tools at height. Various regulations (e.g., OSHA regulations) may require a lanyard when an operator uses tools height. When a tool is dropped at height, the lanyard couples the tool to an anchor point and prevents the tool from dropping. This prevents a safety hazard and also protects the tool from the destructive influence of the fall.

Lanyards are designed to absorb and dissipate the energy of a fall. Lanyards that are too stiff may break or snap at the attachment points to either the tool or the anchor point or along the lanyard itself. Stiff lanyards allow a predetermined falling length, but often exhibit brittle material behavior and may break unexpectedly along the lanyard or at the attachment members. This brittle-like behavior is due to the stiff lanyards inability to absorb the energy of the falling object. Elastic materials show a far more ductile response to a falling object, but may not be effective in preventing an object from falling a specified distance. For example, a first object with a first weight will fall a different distance than a second object with a second weight when attached to the same elastic lanyard. Many factors, such as the height of the fall, the weight of the supported object, the spring constant of the elastic material, and others, determine the length of the deflection needed to support a falling object with an elastic lanyard. For a reliable lanyard, this unpredictability can be problematic.

Applicant has found that the use of a sheath of a stiff or inelastic material, such as nylon, surrounding an elastic material, such as natural rubber, creates a combination lanyard with the beneficial effects from both materials. The lanyard has a predictable limit to the total deflection defined by the total extended length of the inelastic sheath. In addition, the elastic properties of the cords within the lanyard absorb and dissipate most, if not all, the energy of the fall. This elastic energy dissipation prevents brittle-like fractures at the attachment points or along the sheath of the lanyard. The inelastic material reliably limits the fall distance.

One common attachment member at the ends of a lanyard is a carabiner. Carabiners can quickly attach to an anchor point, a tool, or a tool tether (coupled to or attached to the tool). Carabiners operate a gate in two positions, an open position and a closed position. In the open position, the carabiner may receive a loop or hook. Carabiners can be biased toward the closed position so that when the loop is received, the carabiner closes around the loop and prevents accidental release. However, often the loop is bigger than the gap or opening created by the carabiner, either between the gate and a first end of the carabiner or between the gate and the internal walls of the carabiner. This can cause binding of the loop within the carabiner and may prevent the carabiner from closing around the loop. Applicant has found that maintaining the distance between the gate and the internal walls of the carabiner to be greater than the distance between the gate and an end of the carabiner; lanyard binding is reduced. This is because there is more room for the lanyard loop once it passes through the gate (e.g., more room on the carabiner) than there is between the gate and the end of the carabiner.

As shown in FIGS. 1-4, a lanyard 10 is provided. The lanyard 10 includes a sheath 14 with a first end 18 and an opposite second end 22. The first end 18 of the sheath 14 is coupled to a first attachment member 24 and the second end 22 is coupled to a second attachment member 28. The extended sheath 14 defines an extended length between the first and second ends 18 and 22 of the sheath 14. As illustrated in FIGS. 1-4, sheath 14 is bunched up or kinked about an elastic cord 34. Thus the full extended sheath 14 is greater than the distance shown. The elastic cord 34 is free to extend within the length of the fully extended sheath 14. The full length of the extended sheath 14 defines a reliable limit for the distance the lanyard 10 will allow attached equipment to fall.

The sheath 14 can be made of nylon or other suitable materials. For example, sheath 14 may be made from natural fibers or wool, cashmere, cotton, silk, linen, hemp, and/or other natural fibers. Sheath 14 may be made from synthetic fibers such as rayon, polyester, acrylic, acetate, nylon, polyamides, and/or other polymers. In this application, "nylon" will refer to any member of the family of polyamides such as nylon 6,6; nylon 6; nylon 6,12; nylon 5,10; and other polyamides. The sheath 14 can be formed from a nylon sheet material or a composite material, e.g., nylon and rubber. The sheath 14 may be formed from less than eighty strands of nylon for every twenty strands of rubber. For example, the sheath 14 may be formed of seventy-four strands of nylon for every twenty-six strands of rubber. The sheath 14 may be formed from seventy strands of nylon for every thirty strands of rubber. The sheath 14 may be formed from sixty strands of nylon for every forty strands of rubber.

In some embodiments, as shown in FIGS. 1, 3, 5 and 6, the lanyard 10 includes a carabiner 26 as a first attachment member 24 and a loop 30 as a second attachment member 28. The loop 30 can be secured to a power tool, and the carabiner 26 can be secured to a fixed anchor point such as building, machine, a balcony rail/post, or other mounting structure. In other embodiments, as shown in FIGS. 2 and 4, the lanyard utilizes carabiners 26 as both the first and second attachment members 24 and 28. In other embodiments, instead of a carabiner 26 or loop 30, the first and second attachment members 24 and 28 can be anything capable of securing the lanyard 10 to a power tool and/or a fixed anchor point. As used herein, a fixed anchor point will refer to any structure that the lanyard is attached to that supports the equipment during a fall. Examples of a fixed anchor point include, but are not limited to, a balcony, a rail or railing, a wall, a support, or other fixed anchor locations for the lanyard.

Figure 2:
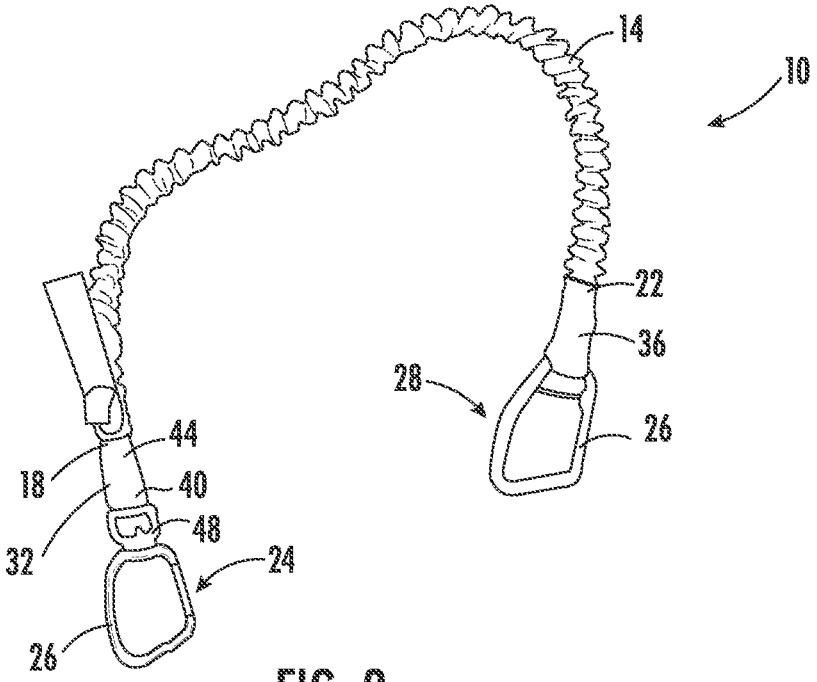
FIG. 2 is a perspective view of a lanyard with two carabiners, according to an exemplary embodiment.

In some embodiments, as shown in FIGS. 1 and 2, lanyard 10 may be coupled to a first linking member 32 and/or a second linking member 36. Linking members 32 and 36 may have different elastic/inelastic properties than lanyard 10. Linking members 32 and 36 may be another lanyard 10 coupled in series. Linking members 32 and 36 can be coupled in a semi-permanent fashion (e.g., through one or more swivels 48) or in a releasable fashion (e.g., through one or more carabiners 26). For example, first linking member 32 can link the first end 18 to the first attachment member 24, such as the carabiner 26, and a second linking member 36 can link the second end 22 to the second attachment member 28, such as the loop 30 in FIG. 1 or another carabiner 26 in FIG. 2. The first and second linking members 32 and 36 can also be made of nylon, nylon composite (e.g., nylon and rubber composite) or any other suitable material.

Figure 9:
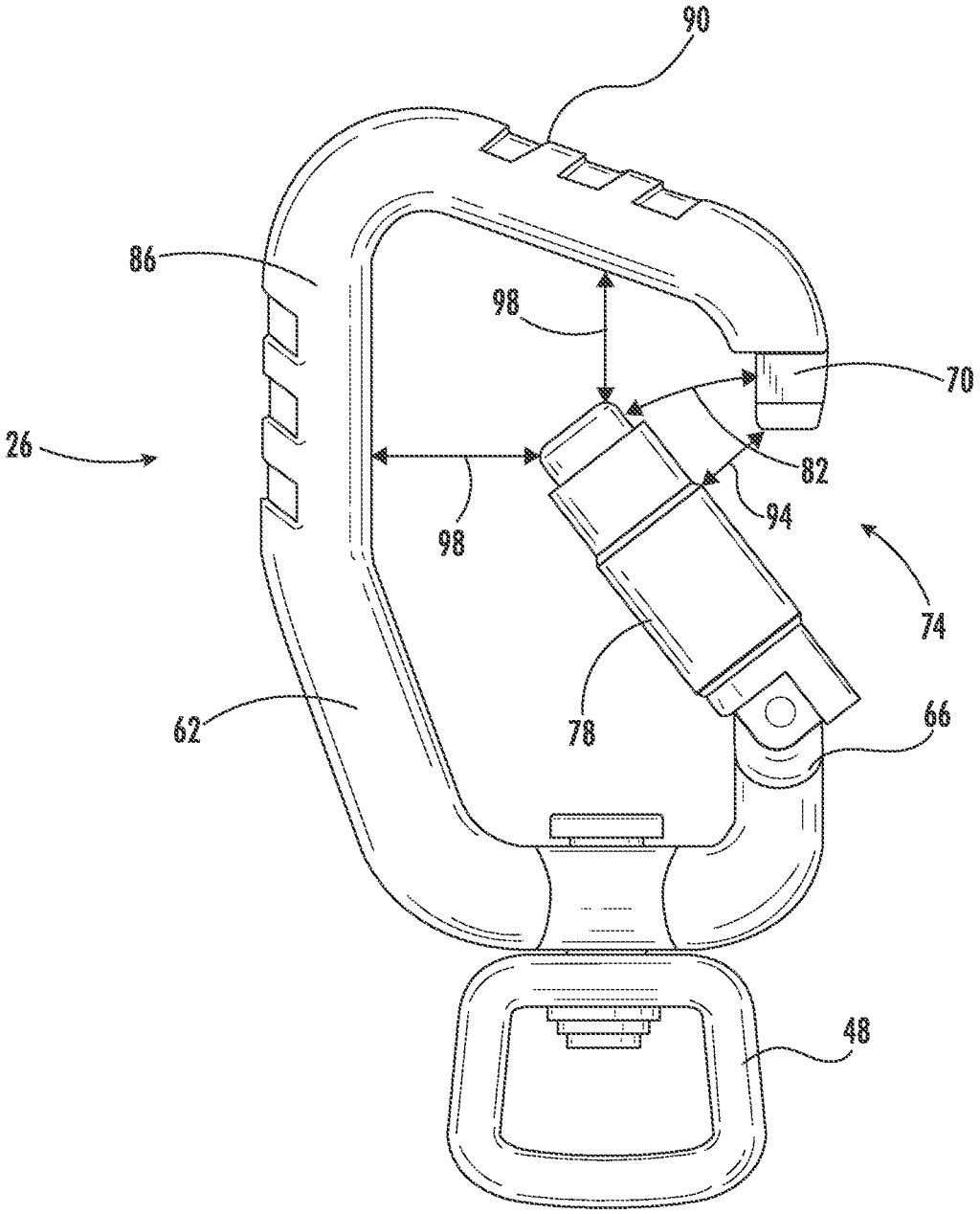
FIG. 9 is a plan view of an open carabiner illustrating a gate separation distance that is less than a wall separation distance, according to an exemplary embodiment.
Figure 10:
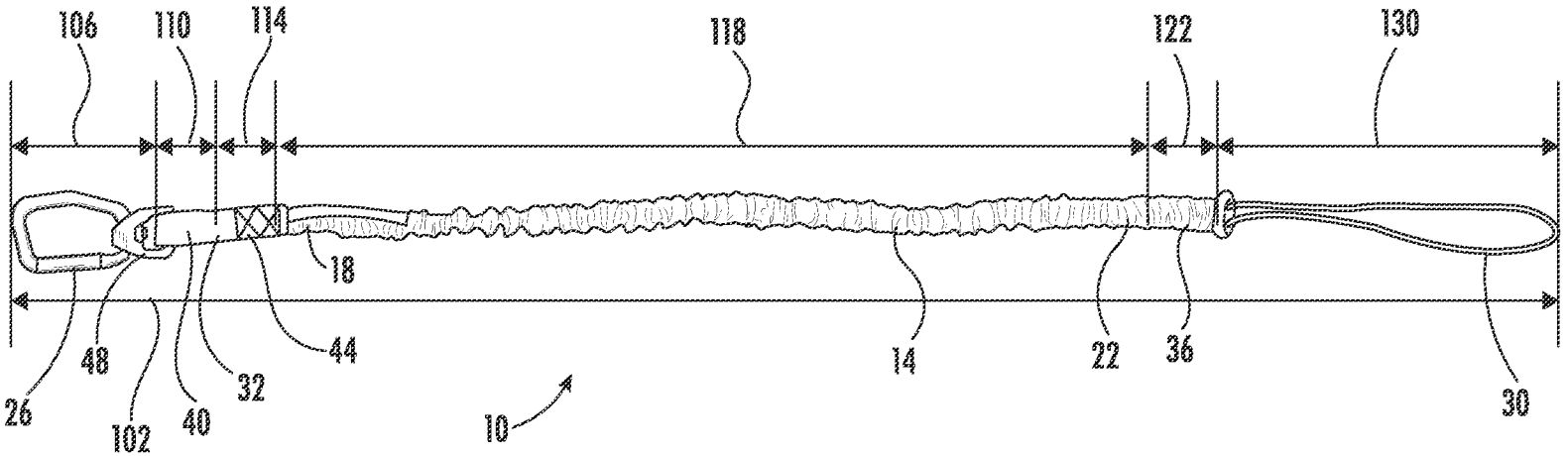
FIG. 10 is a plan view of a lanyard that illustrates sections of the extended lanyard, according to an exemplary embodiment.

As shown in FIGS. 1, 2, and 10, the first linking portion 32 is comprised of a loop section 40 and a stitched section 44 that connects the loop section 40 to the first end 18 of the sheath 14. As shown in FIGS. 1, 2, 3, 6, 8, 9 and 10 the carabiner 26 can include a swivel 48 that permits the carabiner 26 to rotate with respect to the sheath 14. In some embodiments, swivel 48 is fixed and prevents rotation of the carabiner 26. In other embodiments, swivel 48 resists rotation or allows rotation to discrete locations about swivel 48. As shown in FIGS. 1, 2, and 10, the loop section 40 of the first linking member 32 loops around the swivel 48 to couple the carabiner 26 to the first linking member 32.

Figure 3:
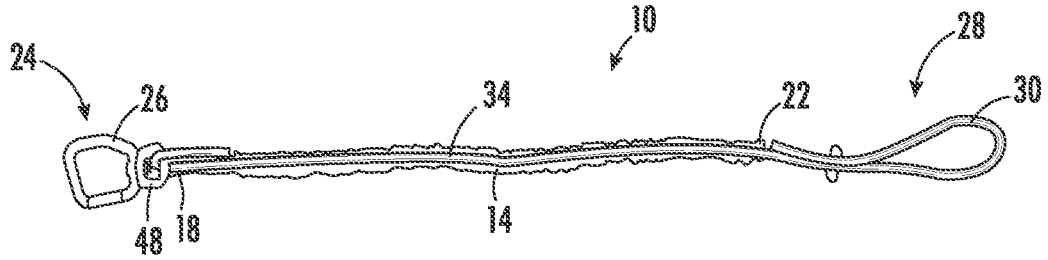
FIG. 3 is a sectional view of a lanyard with a carabiner and a loop formed from a single elastic cord that begins at a first end and terminates at a second end of a sheath, according to an exemplary embodiment.
Figure 4:
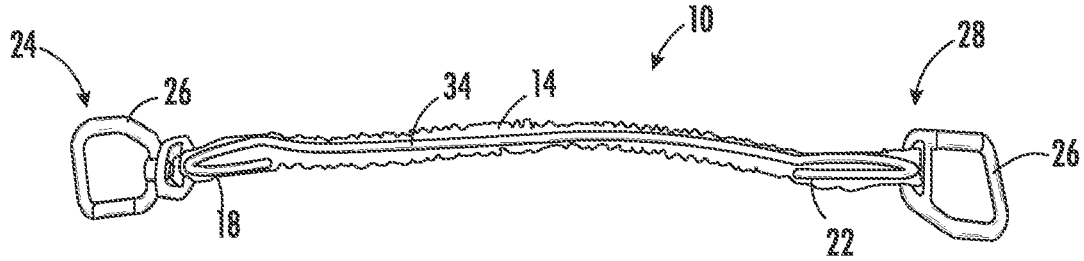
FIG. 4 is a sectional view of a lanyard with two carabiners and one elastic cord, according to an exemplary embodiment.

As shown in FIGS. 3 and 4, lanyard 10 includes an elastic cord 34 within sheath 14. Elastic cord 34 includes a group of individual elastic strands 58 of a natural/synthetic rubber or elastomeric material coiled together to form elastic cord 34. The elastic cord 34 may be formed from rubber or other suitable elastic materials. For example, the elastic cord 34 may be formed of natural rubber, elastomers, elastic polymers, neoprene rubber, unsaturated rubbers (e.g., polyisoprene or nitrile rubber buna-n), saturated rubbers (e.g., ethylene propylene rubber), thermoplastic elastomers (TPE), resilin, elastin, polysulfide rubber, elastolefin, and/or other ductile elastic materials. In addition, a composite sheath 14 or linking portion 32 or 36 may include these materials in proportion to an inelastic material (e.g., nylon). For example, sheath 14 or linking portion 32 or 36 may be formed from less than eighty strands of inelastic material (synthetic or natural, e.g., nylon 6,6) for every twenty strands of an elastic material (synthetic or natural, e.g., polyisoprene or natural rubber).

In some embodiments, as shown in FIG. 3, the elastic cord 34 is coupled to the first attachment member 24 (a carabiner 26) at the first end 18 and defines the second attachment member 28 (a loop 30) external to the second end 22. Sheath 14 surrounds the elastic cord 34 and couples to the carabiner 26 at the first end 18. As shown in FIG. 4, elastic cord 34 can be coupled to carabiner 26 at the first end 18 and another carabiner 26 at the second end 22. For example, a loop 30 defined by the elastic cord 34 may be internal to the sheath 14, such that loop 30 couples to attachment member 28 (e.g., carabiner 26) or sheath 14 (e.g., at sheath end 22) and does not form an external loop 30. Sheath 14 may be coupled to the second attachment member 28 (e.g., carabiner 26) to the internal loop 30. Sheath 14 surrounds elastic cord 34 and couples to the carabiners 26 at the first end 18 and second end 22. In some embodiments, elastic cord 34 is coupled to the first and second linking members 32 and 36 (e.g., as shown in FIGS. 1 and 2). In the embodiments of FIGS. 3 and 4, the elastic cord 34 begins at the first end 18 and terminates at the second end 22 of sheath 14.

Attachment members 24 and 28 may include a carabiner 26, a loop 30, a latch, a tether key or tether end, a buckle, a fastener, or another attachment to a tool or anchor point. Attachment members 24 and 28 may provide an anchor point to lanyard 10 or be a tool holding member. In operation, the first attachment member 24, such as the carabiner 26, can be secured to a fixed anchor point, and the second attachment member 28, such as the loop 30, can be secured to a tool (not shown) used by the operator. In this manner, if and when the operator drops the tool, the tool is elastically supported by the lanyard 10 up to the extended length of sheath 14, which is secured to the anchor point. When the tool reaches the extended length of sheath 14, the inelastic response of the sheath 14 dominates, providing a reliable limit to the distance the falling object travels, regardless of the weight, the height dropped, or other characteristics.

Figure 5:
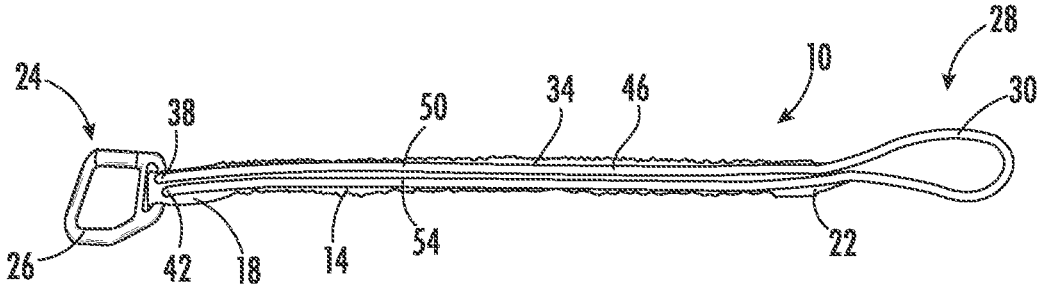
FIG. 5 is a sectional view of a lanyard with a carabiner and a loop formed from a single elastic cord that begins at a first end and terminates at the first end of a sheath, according to an exemplary embodiment.

In some embodiments, as shown in FIG. 5, elastic cord 34 has a first end 38, a second elastic cord end 42, and a body 46 defined between the first and second ends 38 and 42. Both the first end 38 and the second elastic cord end 42 are coupled to carabiner 26. The body 46 is looped outside of the second end 22 of the sheath 14, such that the body 46 defines loop 30. The elastic cord 34 extends beyond the sheath 14 to form the external loop 30. As illustrated in FIG. 5 loop 30 is external to sheath 14. In some embodiments, loop 30 is internal to sheath 14 and couples to an attachment member 24 or 28 (such as an inelastic loop 30 illustrated in FIG. 6 or a carabiner 26).

For example, in FIG. 5 loop 30, defined by elastic cord 34, is external to the sheath 14 and defines the second attachment member 28. Thus, in this embodiment, loop 30 is elastic, and there are two elastic portions 50 and 54 defined by the body 46 of one elastic cord 34. The elastic portions 50 and 54 of body 46 extend within sheath 14 between the first and second ends 18 and 22 of the sheath 14. For example, the first elastic cord end 38 and the second elastic cord end 42 are both attached to the first attachment member 24, and the elastic cord 34 defines a loop 30 between the first attachment member 24 and the second attachment member 28. In other embodiments, loop 30, defined by elastic cord 34, is internal to the sheath 14. The loop 30 does not extend beyond sheath 14 but includes elastic portions 50 and 54 such that the first elastic cord end 38 and second elastic cord end 42 are both attached to sheath 14 at a first end 18. The internal loop 30 may connect to an attachment member 28 at the second end 22 of sheath 14.

The elastic cord 34 may stretch between an un-stretched length and a stretched length. The un-stretched length is less than the fully extended length of sheath 14. Thus, sheath 14 is bunched up or kinked about the elastic cord 34. The elasticity of the sheath 14 is less than the elasticity of the elastic cord 34. This configuration enables the elastic cord 34 to stretch to absorb energy when lanyard 10 is supporting a falling object. The stretched length of the elastic cord 34 can vary between the un-stretched length of elastic cord 34 and the fully extended length of sheath 14. Between these limits, the stretched length of the elastic cord 34 elastically absorbs the kinetic energy of the falling object.

Figure 6:
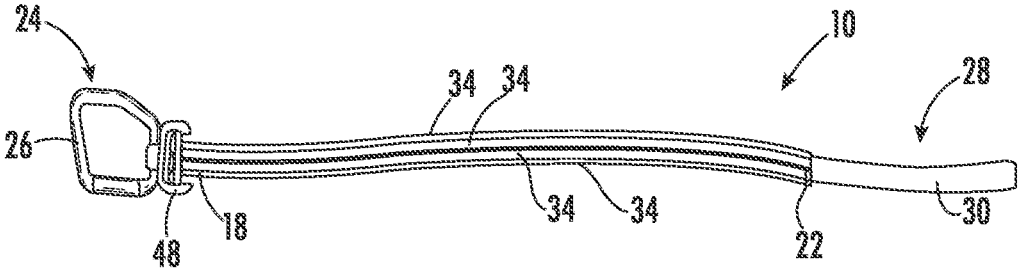
FIG. 6 is a sectional view of a lanyard comprising four elastic cords extending from the first end to the second end of a sheath, according to an exemplary embodiment.

In some embodiments, as shown in FIG. 6, lanyard 10 includes four or more separate elastic cords 34 within sheath 14. In some embodiments, the four or more elastic cords 34 may form loops 30, such that the first elastic cord end 38 and second elastic cord end 42 are both attached to the first attachment member 24, and the elastic cords 34 define a loop 30 between the first attachment member 24 and the second attachment member 28.

In the embodiment of FIG. 6, each elastic cord 34 is separately coupled between attachment members 24 and 28 at either end 18 or 22 of sheath 14. Each elastic cord 34 is coupled between the first attachment member 24 and the second attachment member 28 on the opposite end of sheath 14. The elastic cords 34 are stretchable between an un-stretched length and a stretched length. The un-stretched length is less than the extended length of the sheath 14, and the elasticity of sheath 14 is less than the elasticity of elastic cords 34. As illustrated, attachment members 24 and 28 are a carabiner 26 and an inelastic loop 30 (e.g., nylon and not defined by elastic cords 34), but may include any suitable attachment member 24 or 28. In some embodiments, sheath 14 may include 5, 6, 7, 8, 9, 10, or more separate elastic cords 34 within the lanyard 10 separately coupled between attachment members 24 and 28 or forming loops 30.

Figure 7:
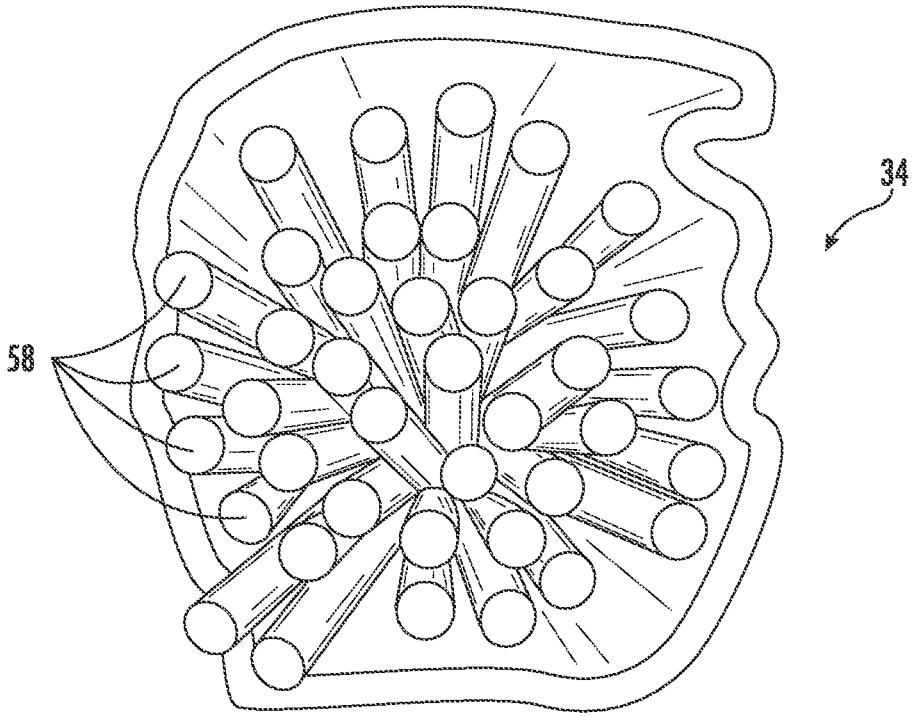
FIG. 7 is a sectional view of one elastic cord of a lanyard, according to an exemplary embodiment.

In some embodiments, as shown in FIG. 7, elastic cord 34 includes between thirty-six and fifty elastic strands 58. Thus, in embodiments such as the one shown in FIG. 5, because there are two elastic portions 50 and 54 within the sheath 14, there are effectively between seventy-two and one hundred elastic strands 58 of rubber between the first and second ends 18 and 22 of sheath 14, but only thirty-six to fifty elastic strands 58 within elastic cord 34. Similarly, in embodiments such as the one shown in FIG. 6, because there are four separate elastic cords 34 within the sheath 14, there are effectively between one hundred forty-four and two hundred elastic strands 58 between the first and second ends 18 and 22 within sheath 14. Additional elastic cords 34 have between N×36 and N×50 elastic strands 58, where N represents the number of elastic cords 34 within sheath 14. For example, five elastic cords 34 (N=5) have between 5×36=180 and 5×50=250 elastic strands 58. In some embodiments, two or more elastic cords 34 may form a loop 30 within sheath 14 to create four or more elastic portions 50 and 54. For example, two elastic cords 34 may form four elastic portions 50 and 54 and comprise between seventy-two and one hundred elastic strands 58 of rubber.

Figure 8:
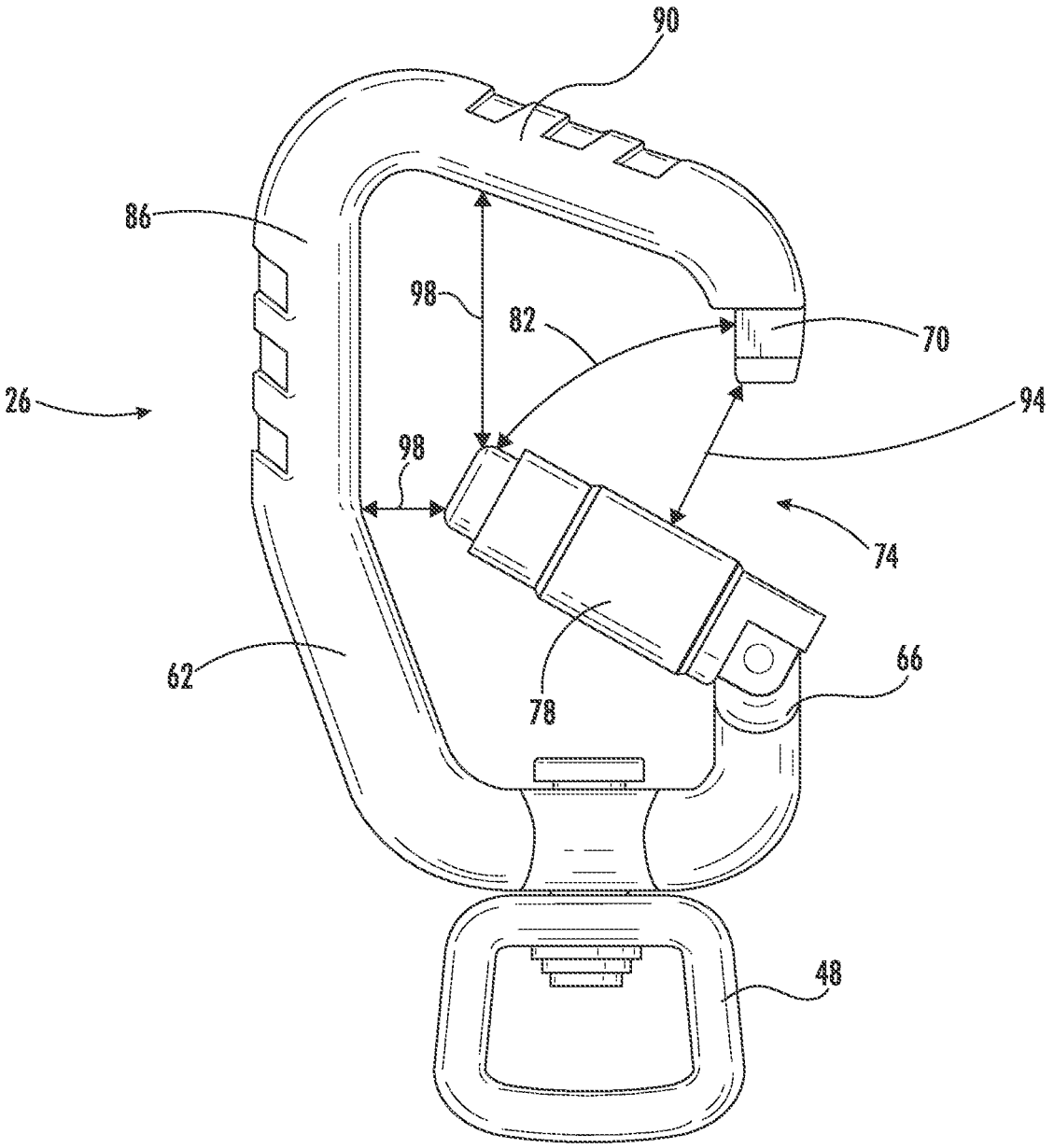
FIG. 8 is a plan view of a carabiner attachment member for a lanyard, according to one embodiment.

Carabiner 26, as shown in FIGS. 8 and 9, has a body 62 with a first end 66 and a second end 70 which functions as a latch or gate 78. Gate 78 is pivotable over a range of motion 82 between a first "closed" position and a second "open" position. For example, when gate 78 moves from the closed position (illustrated in FIGS. 1-6) to the open position (illustrated in FIGS. 7-8), an opening 74 is formed between gate 78 and first end 66. Opening 74 is defined when gate 78 is open between the first end 66 and second end 70 of carabiner 26.

Carabiner 26 may be biased towards the closed position. Applying pressure to gate 78 pivots the gate 78 between the closed position in which the gate 78 engages the second end 70 and the open position, in which the gate 78 has pivoted the maximum possible distance over the range of motion 82, thus maximizing the expanded opening 74. Once pressure is released, gate 78 engages the second end 70 in the closed position. Gate 78 can latch and/or lock to the second end 70 of carabiner 26 to securely close carabiner 26 and keep it closed. In some embodiments, gate 78 is biased by a biasing member, such as a spring (not shown), towards the closed position. Gate 78 may include a lock or cover (not shown) that rotates or slides to cover second end 70 and secure gate 78 in the closed position to prevent accidental opening or release of carabiner 26.

The body 62 of the carabiner 26 may optionally be attached to swivel 48 and includes a first end 66, a first wall portion 86, a second wall portion 90, and a second end 70. The shape of carabiner 26 is defined by body 62 at the first wall portion 86 and the second wall portion 90. The first wall portion 86 is approximately parallel to the gate 78 when the gate 78 is in the closed position and the second wall portion 90 is linked to the first wall portion 86. For example, second wall portion 90 may make an acute, obtuse, or right angle with first wall portion 86. As illustrated, the second wall portion 90 makes an acute angle with the first wall portion 86, which is approximately parallel to gate 78 in the closed position. Other configurations and embodiments of carabiner 26, including non-parallel and/or alternate angles are envisioned.

As shown in FIGS. 8-9, a gate separation distance 94 is defined as the distance between the gate 78 and the second end 70 in the open position where gate 78 has pivoted the maximum possible distance over the range of motion 82 and maximized opening 74. A wall separation distance 98 is defined as the minimum distance between the gate 78 and the first wall portion 86 or the second wall portion 90 over the pivotal range of motion 82. As illustrated in FIG. 8 the horizontal wall separation distance 98 is less than the vertical wall separation distance 98. Thus the wall separation distance 98 is the horizontal wall separation distance 98.

By inspection of FIGS. 8-9 we see two different relationships of the gate separation distance 94 and wall separation distance 98, as defined above. In FIG. 8 the minimum wall separation distance 98 (e.g., horizontal wall separation distance 98) is less than the gate separation distance 94. In FIG. 9 the vertical wall separation distance 98 in the open position is less than the horizontal wall separation distance 98. Therefore the vertical wall separation distance 98 defines the wall separation distance 98. In FIG. 9, the gate separation distance 94 is less than the minimum ("vertical") wall separation distance 98.

Carabiner 26 includes gate 78 pivotably coupled to a first end 66 of carabiner 26. Gate 78 is configured to clasp a second end 70 of the carabiner 26 in a closed position. Rotation of the gate 78 to an open position defines the minimum wall separation distance 98 between gate 78 in the open position and walls 86 and 90 of the carabiner 26. The open position also defines a gate separation distance 94 between the second end 70 of the carabiner 26 and gate 78. In some embodiments, the minimum wall separation distance 98 between the gate 78 and walls 86 and 90 is greater than the gate separation distance 94 between the gate 78 and the second end 70 of carabiner 26.

In the configuration of FIG. 9, the first wall portion 86 and second wall portion 90 are arranged with respect to the gate 78 such that the wall separation distance 98 is greater than the gate separation distance 94. Thus, in the second position of the gate 78, any square or round article, loop, or hook that is large enough to enter the carabiner 26 through the opening 74 can move past gate 78 and allow gate 78 to move back to the closed position. This allows carabiner 26 to lock the article or hook securely. In other words, the first wall portion 86 and second wall portion 90 are arranged with respect to the gate 78 such that the article or hook does not force gate 78 to stay open. Ensuring that the gate separation distance 94 is less than the minimum wall separation distance 98 reduces binding and ensures that gate 78 can return to the closed position. In this manner, the carabiner 26 of FIG. 9 provides greater ease of use for an operator than the carabiner 26 of FIG. 8.

Figure 11:
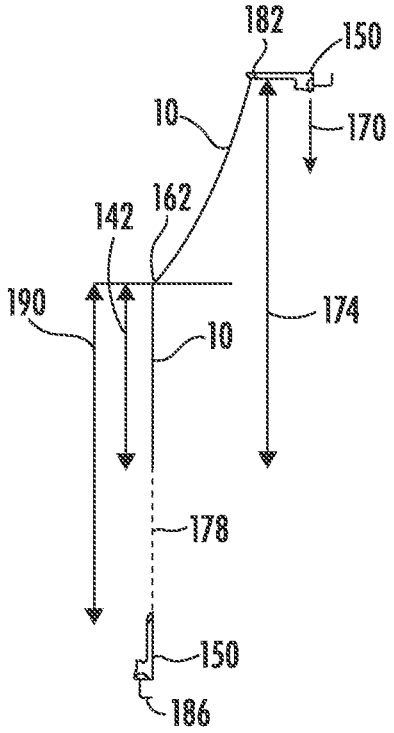
FIG. 11 is a plan view of a drop test of the lanyard of FIG. 10.
Figure 17:
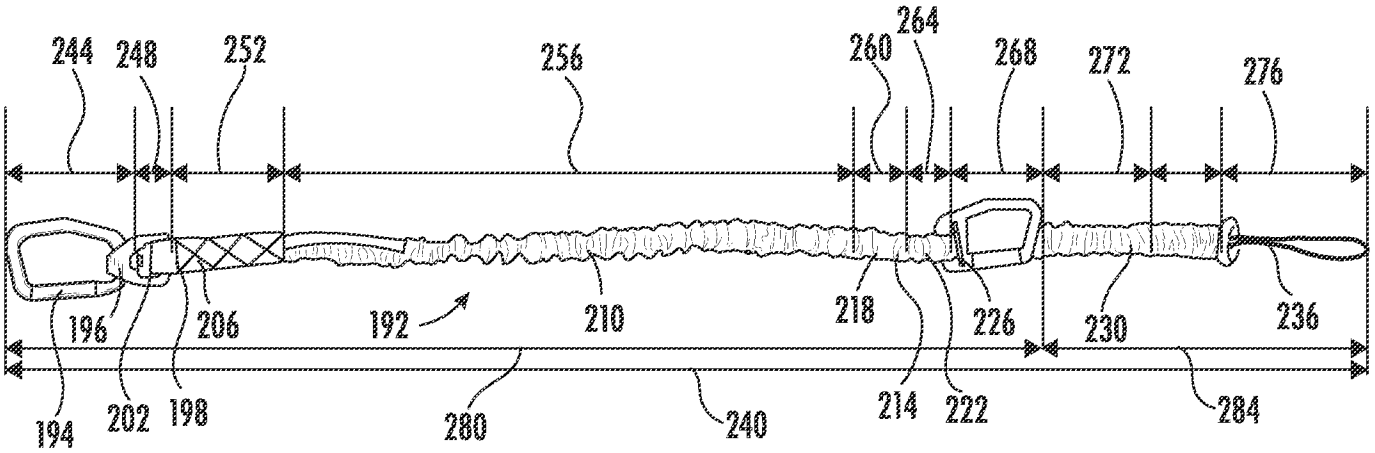
FIG. 17 is a plan view of a lanyard coupled to a tether for securing a tool, according to an exemplary embodiment.

FIGS. 10-19 illustrate the lengths of various lanyards 10 measured in the test. FIGS. 10 and 17 define two tested configurations of lanyard 10. FIG. 11 illustrates the test methodology. FIGS. 12-16 illustrate the measured results of the test applied to lanyard 10 of FIG. 10. FIGS. 18-19 illustrate the measured results of the test applied to lanyard 10 of FIG. 17.

As shown in FIG. 10, a total length 102 of the lanyard 10 can be broken down into six separate sub-lengths: (1) a length 106 of the carabiner 26; (2) a length 110 of the loop section 40; (3) a length 114 of the stitched section 44; (4) a length 118 of the elastic cord(s) 34 (not shown in FIG. 10) between the first and second ends 18 and 22 and within the sheath 14; (5) a length 122 of the second linking member 36; and (6) a length 130 of the loop 30. The purpose of the test is to see how the elasticity of these lengths varies while supporting various weights dropped from the height of the un-stretched elastic cord(s) 34 above a fixed anchor point (or 2×'s the unsupported distance of the un-stretched elastic cord(s) 34).

FIG. 11 shows the positions of the lanyard 10 both before and after a 2× drop test. The drop test height column of the Table in FIG. 12 uses the reference "2×" when referring to the lanyard 10 being dropped, as indicated by arrow 170, from a height 174 that is two times the un-tensioned length 142 of the elastic cords 34 within lanyard 10. The un-tensioned length 142 of the lanyard 10 shown in FIG. 11 corresponds to "Pre-drop total length 102" column or the un-tensioned length of the lanyard 10 for the 2× drop test trials. A dotted line 178 indicates when the elastic cords 34 within lanyard 10 become tensioned and stretch. The test is designed to not extend to the fully extended length of sheath 14 to test the elastic response of the lanyard 10 system. For the lanyard 10 tests of FIG. 10, tool 150 is secured to loop 30 and dropped from an initial position 182 (2× the un-stretched length of the elastic cord(s) 34) to a final position 186 in which the elastic cord(s) 34 is fully stretched within sheath 14. Carabiner 26 of lanyard 10 is secured at the point 162. A fully stretched length 190 of elastic cord(s) 34 and other components of lanyard 10, shown in FIG. 11, corresponds to the "Stretched Total Length 102" column in the Table for the 2× drop test height trials.

For each category of weight-rated lanyard 10, there are three types of drop tests, as explained below. First, the lanyard 10 was subjected to a first 2× drop test while supporting the rated weight of the lanyard 10 and a peak force on the lanyard 10 was measured for this first drop. Second, the lanyard 10 was subjected to nine more individual 2× drop tests while supporting the rated weight of lanyard 10. For each of these nine additional drops, the peak force on lanyard 10 was measured. The value listed in the Table in FIG. 12 represents the maximum individual peak force measured among the ten total drops, which includes the first drop and the nine subsequent drops supporting the rated weight of lanyard 10. Third, lanyard 10 was subjected to three 2× drop tests while supporting two times the rated weight of lanyard 10, and the peak force was measured for each of those three drops. The maximum individual peak force measured among those three drops is listed in the table of FIG. 12. For example, for the ten-pound weight-rated lanyard 10 with a total pre-drop length of 921 mm, the peak force of the first drop while supporting ten pounds was 82 lbf, the maximum peak force over ten drops while supporting ten pounds was 123 lbf., and the maximum peak force over three drops while supporting twenty pounds was 268 lbf.

During a drop, the length 118 of the elastic cord(s) 34 can change between four separate stages: (1) an initial un-tensioned stage; (2) a tensioned stage when the length of the elastic cord(s) 34 is less than the length of the unkinked sheath 14; (3) a tensioned stage where the length of the elastic cord(s) 34 is equal to the fully extended length of sheath 14; and (4) a fully stretched stage in which the elastic cord(s) 34 and/or the sheath 14 become entirely stretched. In the Table above, the initial un-tensioned stage values are represented in the "Un-tensioned length 118 of elastic cord(s) 34" column, and the fully stretched stage values are represented in the "Fully stretched length 118 of elastic cord(s) 34" column.

When the elastic cord(s) 34 becomes the same length as the unkinked sheath 14, it is between 38% and 115% longer than its un-tensioned length. When the elastic cord(s) 34 becomes the same length as the unkinked sheath 14, the sheath 14 becomes tensioned, and the elastic cord(s) 34 and the sheath 14 begin stretching together as a system. As demonstrated in the Table above, the respective lengths of the sheath 14 and elastic cord(s) 34 are selected to provide a lower peak force when a weight (e.g., of a tool) is near the lanyards' rated weight and when the weight on the tool 150 is dropped from a height greater than the un-tensioned length 142 of lanyard 10.

Because the sheath 14 is inelastic, the fully extended length of sheath 14 roughly defines a limiting tension length of lanyard 10. When the one or more elastic cords 34 within sheath 14 are stretched between a pre-tensioned length and a tensioned length, they are unrestrained up to the fully extended length of the sheath 14. When the tensioned length reaches the length of the fully extended sheath 14, the elastic cords 34 reach the limiting tension length of lanyard 10. Thus, the tensioned length of the elastic cord(s) 34 is less than or equal to the limiting tensioned length of sheath 14. In some embodiments, the limiting tension length of sheath 14 is between 30% and 125% greater than the pre-tensioned length of the elastic cord(s) 34. In some embodiments, the limiting tension length of sheath 14 is between 38% and 115% greater than the pre-tensioned length of elastic cord(s) 34. The limiting tension length of sheath 14 may be between 45% and 110% of the pre-tensioned length of elastic cord(s) 34. The limiting tension length of sheath 14 may be between 50% and 105% of the pre-tensioned length of elastic cord(s) 34. The limiting tension length of sheath 14 may be between 55% and 100% of the pre-tensioned length of elastic cord(s) 34.

In the tests described below, the length of the sheath 14 was selected to study the elastic properties of the elastic cord(s) 34. As such, the length of sheath 14 was selected to be greater than the elastic response of the lanyard 10 system to prevent the limiting tensioning length of the sheath 14 from interfering with the test results.

As shown in the Table in FIG. 12, test data of different weight-rated lanyards 10 demonstrate the respective stretching lengths of the above six sub-lengths when the lanyards 10 are subjected to different drop tests. In all of the drop tests listed in the Table of FIG. 12, the length 106 of the carabiner 26 remains constant at 86 mm and does not change as the lanyard 10 stretches. Similarly, in all of the tests, the length 114 of the stitched section 44 of sheath 14 remains constant at 36 mm and the length 122 of the second linking member 36 (e.g., nylon) remains constant at 36 mm. In other words, none of the lengths 106, 114, 122 change as the lanyard 10 is stretched while dropped. Because the sheath 14 has a large modulus of elasticity (spring constant) and a lower elasticity than the elastic cord(s) 34, the sheath 14 limits the length the lanyard 10 can stretch.

FIGS. 13-16 illustrate data from the drop tests correlating respectively to the 10 lb. weight-rated lanyard 10 with a pre-drop total length 102 of 921 mm, the 10 lb. weight-rated lanyard 10 with a pre-drop total length 102 of 1381 mm, the 15 lb. weight-rated lanyard 10, and the 50 lb. weight-rated lanyard 10, as related to the results shown in FIG. 12.

In another embodiment of a lanyard 192 shown in FIG. 17, the lanyard 192 includes, in series, a first carabiner 194, a swivel member 196, a first linking member 198 including a loop section 202 and a stitched section 206, a sheath 210, a second linking member 214 including a stitched section 218 and a loop section 222, a second carabiner 226, a tether 230, and a tether attachment member 236. As in previous embodiments, elastic cord(s) 34 (not shown in FIG. 17) is arranged within sheath 210 and is coupled between the stitched section 206 of the first linking member 198 and the stitched section 218 of the second linking member 214.

As shown in FIG. 17, a total length 240 of the lanyard 192 can be broken down into nine separate sub-lengths: (1) a length 244 of first carabiner 194; (2) a length 248 of loop section 202; (3) a length 252 of stitched section 206; (4) an unstretched length 256 of elastic cord(s) 34 (not shown in FIG. 17) between the stitched section 206 of the first linking member 198 and the stitched section 218 of the second linking member 214 and within the sheath 210; (5) a length 260 of the stitched section 218; (6) a length 264 of the loop section 222; (7) a length 268 of the second carabiner 226; (8) a length 272 of the tether 230; and (9) a length 276 of the tether attachment member 236. Additionally, total length 240 can be subdivided into first sub-length 280, from first carabiner 194 to second carabiner 226, and a tether 230 sub-length 284, from tether 230 to tether attachment member 236.

The same drop tests illustrated in FIG. 11 were performed with lanyard 192 in the same manner as described above, and the results are listed in a Table shown in FIG. 18. In all of the drop tests listed in the Table of FIG. 18, the lengths 244, 268 of the first and second carabiners 194 and 226 both remain constant at 86 mm and 96 mm, respectively, and do not change as the lanyard 192 stretches. Similarly, in all of the tests, the length 252 of the stitched section 206 of sheath 14 and the length 260 of the stitched section 218 of sheath 14 both remain constant at 36 mm. In other words, none of the lengths 244, 252, 260 and 268 change as the lanyard 192 is stretched while dropped. This suggests that the sheath 14 has a large modulus of elasticity or spring constant and a lower elasticity than the elastic cord(s) 34. Thus the length of sheath 14 defines a practical limit to the total extension of the lanyard 10. The elastic cord(s) 34 is free to stretch and absorb the energy of a fall up to the extended length of sheath 14.

FIG. 19 illustrates data from the drop tests correlating respectively to the lanyard 192, as related to the results shown in FIG. 18. Specifically it shows the percentage elongation of the elastic cord(s) 34 for 2× tests on (1) the first drop at the rated weight, (2) the maximum elongation after 10 drops at the rated weight, and (3) the maximum elongation after 3 drops at twice the rated weight for lanyard 192.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A lanyard comprising:

a sheath comprising:

a first end coupled to a first attachment member;

a second end coupled to a second attachment member, wherein a linear distance between the first end and the second end of the sheath defines a length of the sheath; and an elastic cord having an un-tensioned length within the sheath between the first end and the second end, wherein the un-tensioned length of the elastic cord increases between 38% and 115% until the elastic cord extends to the length of the sheath.

2. The lanyard of claim 1, wherein an elasticity of the sheath is less than the elasticity of the elastic cord.

3. The lanyard of claim 1, wherein a total tensioned length of the lanyard is between 21% and 91% greater than an un-tensioned length of the lanyard.

4. The lanyard of claim 1, further comprising a tether coupled to one of the first or the second attachment member, wherein an un-tensioned length of the tether further increases between 21% and 27% of the un-tensioned length of the tether under a dropped load of between 10 to 15 lbs.

5. The lanyard of claim 1, wherein at least one attachment member is a carabiner, and wherein the carabiner includes a gate pivotably coupled to a first end of the carabiner and configured to clasp a second end of the carabiner in a closed position, wherein rotation of the gate to an open position defines a minimum wall separation distance between the gate in the open position and one or more walls of the carabiner and a gate separation distance between the second end of the carabiner and the gate, wherein the minimum wall separation distance is greater than the gate separation distance.

6. The lanyard of claim 1, further comprising a first elastic cord end and a second elastic cord end, wherein the first elastic cord end and the second elastic cord end are both attached to the first end of the sheath.

7. The lanyard of claim 6, further comprising a loop extending beyond the sheath and defined by the loop formed in the elastic cord, the loop defining the first attachment member, wherein the sheath is coupled to the second attachment member.

8. The lanyard of claim 1, wherein the first attachment member is a carabiner and the second attachment member is a loop of the elastic cord external to the sheath.

9. The lanyard of claim 8, wherein a length of the second attachment member extends between 40% and 64% longer than an un-tensioned length of the loop when a load of between 10 to 15 lbs is dropped from a height that is two times the un-tensioned length of the elastic cord within the sheath.

10. A lanyard comprising:

an elastic cord extending between a first end and a second end opposite the first end, wherein the elastic cord comprises elastic strands; and a sheath surrounding the elastic cord and coupled to the elastic cord at the first end and at the second end, the sheath comprising less than 80 strands of nylon for every 20 elastic strands in the elastic cord.

11. The lanyard of claim 10, wherein the sheath comprises 74 strands of nylon for every 26 elastic strands.

12. The lanyard of claim 10, further comprising a loop in the elastic cord, wherein the loop is coupled to the first end of the sheath and extends externally from the sheath to form a second attachment member.

13. The lanyard of claim 10, wherein the elastic cord comprises between thirty-six and fifty individual elastic strands.

14. The lanyard of claim 10, further comprising a carabiner that includes a gate pivotably coupled to a first end of the carabiner, the gate is configured to clasp a second end of the carabiner in a closed position, wherein rotation of the gate to an open position defines a minimum wall separation distance between the gate in the open position and one or more walls of the carabiner and a gate separation distance between the second end of the carabiner and the gate, wherein the minimum wall separation distance is greater than the gate separation distance.

15. The lanyard of claim 10, further comprising a second elastic cord, wherein the first and second elastic cords form a total of four elastic portions within the sheath, and wherein each of the first and second elastic cords comprises between thirty-six to fifty elastic strands.

16. The lanyard of claim 15, wherein the first and second elastic cords form a loop within the sheath comprising four elastic portions between the first end and the second end of the sheath.

17. The lanyard of claim 10, further comprising three additional elastic cords, such that there are four or more elastic cords within the sheath, and wherein the sheath comprises natural rubber.

18. The lanyard of claim 17, wherein the four or more elastic cords within the sheath comprise a total of between one hundred forty-four and two hundred elastic strands within the sheath between the first end and the second end.

19. A carabiner, comprising:

a body comprising:

a first end; and a second end; and a gate pivotably coupled to the first end of the carabiner, the gate configured to clasp the second end of the carabiner in a closed position, wherein rotation of the gate to an open position defines a minimum wall separation distance between the gate in the open position and walls of the carabiner and a gate separation distance between the second end of the carabiner and the gate, wherein the minimum wall separation distance is greater than the gate separation distance.

20. The carabiner of claim 19, further comprising a swivel coupled to the body and a lanyard, and wherein the gate is biased towards a closed position and comprises a locking cover that slides to cover the second end of the body and secure the gate.

* * * * *